United States Patent [19]

Kuramoto

[11] Patent Number: 4,687,178

[45] Date of Patent: Aug. 18, 1987

[54] WAX RING TUBE WITH GRADUATIONS

[76] Inventor: Yasuo Kuramoto, No. 204, Nogiwa Mansion, 17-5, Sengen-cho 2-chome, Higashikurume-shi, Tokyo, Japan

[21] Appl. No.: 824,781

[22] Filed: Jan. 31, 1986

[30] Foreign Application Priority Data

Feb. 7, 1985 [JP] Japan ..... 60-16477[U]

[51] Int. Cl.[4] ..... B22C 7/02; B28B 7/34

[52] U.S. Cl. ..... 249/53 R; 164/35; 164/246; 249/57; 249/62; 249/175

[58] Field of Search ..... 249/53 R, 54, 57, 62, 249/63, 175; 164/34–36, 45, 245, 246

[56] References Cited

U.S. PATENT DOCUMENTS

| | | | |
|---|---|---|---|
| 2,456,424 | 12/1948 | Neiman | 164/246 |
| 3,396,934 | 8/1968 | Ferris | 164/35 |
| 3,991,809 | 11/1976 | Voegele | 164/35 |

*Primary Examiner*—Jay H. Woo
*Assistant Examiner*—James C. Housel
*Attorney, Agent, or Firm*—Moonray Kojima

[57] ABSTRACT

A wax ring tube used in manufacture of a ring-like ornament by casting it using a lost-wax process. Plotting graduations are formed on inner peripheral wall surface of a hole bored along the lengthwise direction of a wax ring tube body.

3 Claims, 2 Drawing Figures

WAX RING TUBE WITH GRADUATIONS

DESCRIPTION OF FIELD OF THE INVENTION AND ASSOCIATED ART

The present invention relates to a wax ring tube used in the manufacture of ring-like ornaments such as a finger ring by casting them using a lost-wax process.

A tubular wax ring tube used when a ring is made by a lost-wax process is in the form of a rod-like wax body having a section of a ring design, often referred to as a seal bed or a circle, the wax body being formed with a circular hole in lengthwise direction. In use, the wax ring tube is cut into a suitable length by means of a fret saw or the like, and the hole previously formed in the center is rebored into a size as required, after which the surface thereof is cut while adjusting it to the design to prepare a wax pattern in the shape of a ring.

Conventional wax ring tube as described above has disadvantages that when, after the wax has been cut with a fret saw, said cut surface is shaved by a file while being adjusted to the width of the ring, or when the inside thereof is shaved by a file in order to rebore a center hole into a size as required, a center axis of the hole becomes inclined to make a thickness of peripheral walls of the hole uneven, and that the width of the ring is apt to be deviated, thus making it difficult to perform an accurate work and taking much time.

OBJECT AND SUMMARY OF THE INVENTION

It is an object of the present invention to provide a wax ring tube suitable for obtaining an accurate wax pattern.

The wax ring tube according to the present invention is designed so that a hole in the form of a regular circle having a predetermined size is originally provided in a wax body, and plotting graduations are printed on the inner surface of the regular circular hole.

DETAILED DESCRIPTION OF THE PREFERRED EMBODIMENT OF THE INVENTION

Figure 1:
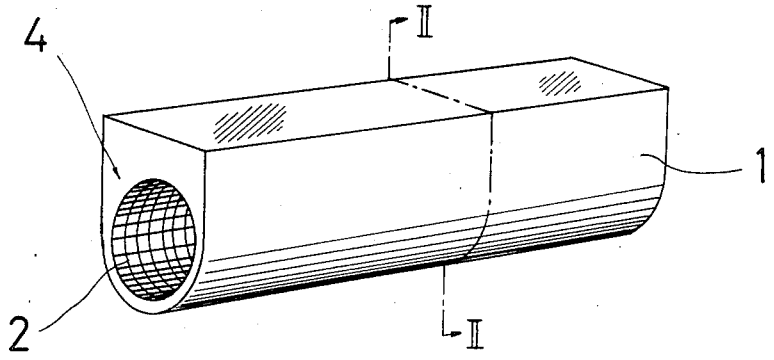
FIG. 1 is a perspective view showing one example of a wax ring tube according to the present invention.
Figure 2:
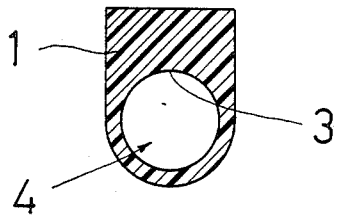
FIG. 2 is a sectional view taken on line II—II of the wax ring tube shown in FIG. 1.

One embodiment of the present invention will now be described with reference to the drawings.

In a wax ring tube according to the present invention in order to manufacture a ring for a seal bed, a regular circular hole 4 having a predetermined ring size is provided along the lengthwise of a rod-like wax body 1 in the form of a ring design or seal bed, and plotting graduations 2 are printed on the inner surface of the hole 4. In case of the wax ring tube in the shape of the ring design or seal bed, as in the illustrated embodiment, it is possible to easily tell a longitudinal cross-sectional center of the ring by making red lines graduations 3 at lines where the sectional shape is symmetrical to left and right of the lines, which lines are the lengthwise graduations provided on the inner surface of the hole 4.

Where a wax ring is manufactured by using a ring tube according to the present invention, a rod-like wax is cut by a fret saw into a length as required, after which the inner graduations 3 are viewed to confirm a bend of a cut end. Since the hole 4 having the required size has been originally provided in the center, machining of the surface thereof is immediately carried out. In machining the ring in the shape of a ring design or seal bed, the ring may be machined so as to provide a symmetrical configuration to left and right with respect to the red lines of the inner plotting graduations since the red lines 3 of the graduations pass the longitudinal center, thereby simply machining the ring in the shape of a configuration symmetrical to left and right.

Mentioning of a process for printing the graduations on the inner peripheral walls of the hole of the wax ring tube, a paper with plotting graduations printed thereon is wound about a size rod for a ring prior to pouring wax into a mold, the size rod with the paper is set in the center of the mold along the longitudinal direction of the mold, and melted wax is poured into the mold. After the wax is cooled and solidified, the size rod and paper set in the wax are removed. Thus, the plotting graduations are transferred onto the inner surface of the hole having a predetermined size.

The thus machined wax pattern is formed into a ring as a product in a conventional manner through the steps of pouring an embedding material, baking, teeming, mold-rupture, and finishing.

By the use of the wax ring tube according to the present invention, time for making a hole may be omitted and in addition, work can be carried out easily and accurately while viewing the inner plotting graduations and confirming the symmetric form of the ring. Therefore, accurate work may be performed in a short period of time without reliance on a hunch.

What is claimed is:

1. A wax ring tube used in the manufacture of a ring by casting with a lost-wax process, said wax ring tube comprising a body having a circular hole bored lengthwise therein, said hole having an inner peripheral wall surface and a plurality of plotting graduations printed on said inner peripheral wall surface of said hole, said plurality of graduations comprising a first set of parallel printed lines extending axially in said hole and a second set of parallel printed lines extending circumferentially in said hole and intersecting the set of axially extending lines.

2. The tube of claim 1, wherein said hole has a predetermined diameter size.

3. The tube of claim 1, wherein said body is shaped to be of a ring design, and wherein one line extending axially is printed of red color and is located in a longitudinal cross sectional plane where a section of the body on one side of said plane is symmetrical to the section of the body on the other side of said plane.

* * * * *